US005636692A

United States Patent [19]

Haugen

[11] Patent Number: 5,636,692

[45] Date of Patent: Jun. 10, 1997

[54] CASING WINDOW FORMATION

[75] Inventor: David M. Haugen, League City, Tex.

[73] Assignee: Weatherford Enterra U.S., Inc., Houston, Tex.

[21] Appl. No.: 568,878

[22] Filed: Dec. 11, 1995

[51] Int. Cl.[6] ..... E21B 43/116

[52] U.S. Cl. ..... 166/298; 166/382; 166/117.6; 166/55.2

[58] Field of Search ..... 166/117.6, 123, 166/382, 297, 298

[56] References Cited

U.S. PATENT DOCUMENTS

| | | | |
|---|---|---|---|
| H1598 | 10/1996 | O'Reilly et al. | 102/202.8 |
| 2,067,408 | 1/1937 | Morris | 166/63 |
| 2,080,875 | 5/1937 | Pitzer | 166/299 |
| 2,141,827 | 12/1938 | Schlumberger | 102/1 |
| 2,214,226 | 9/1940 | English . | |
| 2,302,567 | 11/1942 | O'Neill | 166/1 |
| 2,315,496 | 4/1943 | Boynton | 166/1 |
| 2,519,116 | 8/1950 | Crake . | |
| 2,621,351 | 12/1952 | Piety | 15/104.05 |
| 2,629,445 | 2/1953 | Dill | 166/55 X |
| 2,680,487 | 6/1954 | Carpenter | 166/1 |
| 2,703,053 | 3/1955 | Castel | 102/20 |
| 2,858,653 | 11/1958 | Guptill, Jr. | 51/282 |
| 2,918,125 | 12/1959 | Sweetman | 166/55 X |
| 3,066,736 | 12/1962 | Venghiattis | 166/55.1 |
| 3,076,507 | 2/1963 | Sweetman | 166/55 X |
| 3,138,207 | 6/1964 | Peppers | 166/63 |
| 3,273,642 | 9/1966 | Karpovich | 166/299 |
| 3,318,395 | 5/1967 | Messmer | 175/14 |
| 3,654,866 | 4/1972 | Fritz | 102/312 |
| 3,874,461 | 4/1975 | Cocanower | 175/4.6 |
| 3,878,786 | 4/1975 | Ridgeway | 102/27 R |
| 3,951,218 | 4/1976 | Sjogren | 175/4.6 |
| 3,965,993 | 6/1976 | LaVigne et al. | 175/4.6 |
| 3,990,507 | 11/1976 | Vann | 166/55.1 |
| 3,990,512 | 11/1976 | Kuris | 166/299 |
| 4,071,096 | 1/1978 | Dines | 175/4.6 |
| 4,078,611 | 3/1978 | Vann | 166/297 |
| 4,106,561 | 8/1978 | Jerome et al. | 166/55.2 |
| 4,113,016 | 9/1978 | Trott | 166/297 |
| 4,119,148 | 10/1978 | Deardorf | 166/250 |
| 4,122,899 | 10/1978 | Brieger | 166/297 |
| 4,180,131 | 12/1979 | Chammas | 166/297 |
| 4,354,433 | 10/1982 | Owen | 102/307 |
| 4,357,873 | 11/1982 | Jager | 102/310 |
| 4,409,481 | 10/1983 | Huber et al. | 166/297 |
| 4,509,604 | 4/1985 | Upchurch | 175/4.52 |

(List continued on next page.)

OTHER PUBLICATIONS

"Seminar on Oilfield Explosives," Ensign–Bickford Co., 1995.

"Recommended Practices For Oilfield Explosives Safety," American Petroleum Institute, 1994.

"Perforating Technology For the 21st Century," Hart's Pertoleum Engineer Int'l, Sep. 1996, pp. 61–81.

*Primary Examiner*—Frank Tsay
*Attorney, Agent, or Firm*—Guy McClung

[57] ABSTRACT

A new casing opening formation apparatus has been invented which includes an explosive charge and an apparatus for positioning the explosive charge in a casing in a cased wellbore at a desired location. In one aspect the apparatus includes a drill bit or other drilling device releasably connected to a bit diversion device; and in another aspect the apparatus includes milling apparatus for milling the casing. In one aspect the opening created is a radial ledge for facilitating casing penetration by a mill which mills out a window. In one aspect the opening created has such a radial ledge and includes a slot for inhibiting or preventing coring of the mill. In one aspect the opening created is such a slot alone. In one aspect the opening created is a completed window for sidetracking operations, no further milling is needed and drilling commences in the formation adjacent the explosively created opening. In one aspect the positioning apparatus is a whipstock and a mill is releasably secured to the whipstock to mill past a hole in the casing created by explosion of the explosive charge so that a desired casing window is formed in a single trip of the apparatus into the wellbore.

30 Claims, 1 Drawing Sheet

U.S. PATENT DOCUMENTS

| | | | |
|---|---|---|---|
| 4,511,296 | 4/1985 | Stol | 411/20 |
| 4,560,000 | 12/1985 | Upchurch | 166/55.1 |
| 4,598,769 | 7/1986 | Robertson | 166/55 |
| 4,601,498 | 7/1986 | Haugen | 285/332.3 |
| 4,612,985 | 9/1986 | Rubbo et al. | 166/114 |
| 4,614,156 | 9/1986 | Colle, Jr. et al. | 102/312 |
| 4,616,718 | 10/1986 | Gambertoglio | 175/4.54 |
| 4,655,298 | 4/1987 | George et al. | 175/4.52 |
| 4,662,450 | 5/1987 | Haugen | 166/299 |
| 4,669,540 | 6/1987 | Luoma et al. | 166/135 |
| 4,694,754 | 9/1987 | Dines et al. | 102/310 |
| 4,716,963 | 1/1988 | George et al. | 166/123 |
| 4,726,610 | 2/1988 | George et al. | 285/39 |
| 4,760,884 | 8/1988 | Haugen et al. | 166/377 |
| 4,762,179 | 8/1988 | Wesson et al. | 166/297 |
| 4,787,315 | 11/1988 | Kenny | 102/313 |
| 4,796,709 | 1/1989 | Lynde et al. | 166/55.6 |
| 4,798,244 | 1/1989 | Trost | 166/250 |
| 4,800,958 | 1/1989 | Haugen et al. | 166/55.1 |
| 4,886,126 | 12/1989 | Yates, Jr. | 175/4.54 |
| 4,887,668 | 12/1989 | Lynde et al. | 166/55.8 |
| 4,898,244 | 2/1990 | Schneider et al. | 166/297 |
| 4,901,802 | 2/1990 | George et al. | 175/4.52 |
| 4,905,759 | 3/1990 | Wesson et al. | 166/55 |
| 4,924,952 | 5/1990 | Schneider | 175/4.54 |
| 4,938,291 | 7/1990 | Lynde et al. | 166/55.8 |
| 4,969,525 | 11/1990 | George et al. | 166/297 |
| 4,978,260 | 12/1990 | Lynde et al. | 166/55.6 |
| 4,984,488 | 1/1991 | Lunde et al. | 166/55.6 |
| 5,014,778 | 5/1991 | Lynde et al. | 166/55.6 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,101,907 | 4/1992 | Schultz et al. | 166/386 |
| 5,103,906 | 4/1992 | Schultz et al. | 166/264 |
| 5,150,755 | 9/1992 | Cassel et al. | 166/297 |
| 5,167,282 | 12/1992 | Schneider et al. | 166/297 |
| 5,199,513 | 4/1993 | Stewart et al. | 175/73 |
| 5,238,070 | 8/1993 | Schultz et al. | 166/386 |
| 5,279,363 | 1/1994 | Schultz et al. | 166/53 |
| 5,297,630 | 3/1994 | Lynde et al. | 166/297 |
| 5,301,755 | 4/1994 | George et al. | 166/297 |
| 5,373,900 | 12/1994 | Lynde et al. | 166/297 |
| 5,435,394 | 7/1995 | Robertson | 166/382 |
| 5,456,312 | 10/1995 | Lynde et al. | 166/55.6 |
| 5,467,824 | 11/1995 | DeMarsh et al. | 166/297 |
| 5,477,785 | 12/1995 | Dieman et al. | 102/313 |
| 5,483,895 | 1/1996 | Tomek et al. | 102/312 |
| 5,490,563 | 2/1996 | Wesson et al. | 166/297 |
| 5,495,806 | 3/1996 | Willey . | |
| 5,499,579 | 3/1996 | Lewis . | |
| 5,501,153 | 3/1996 | Cassagne et al. . | |
| 5,501,154 | 3/1996 | Rodney et al. . | |
| 5,503,077 | 4/1996 | Motley | 102/202.5 |
| 5,503,078 | 4/1996 | LeTual | 102/202.13 |
| 5,505,134 | 4/1996 | Brooks et al. . | |
| 5,505,136 | 4/1996 | Cauchetier et al. . | |
| 5,505,260 | 4/1996 | Andersen et al. | 166/278 |
| 5,505,261 | 4/1996 | Huber et al. | 166/297 |
| 5,507,230 | 4/1996 | Lewis et al. . | |
| 5,524,523 | 6/1996 | Lubbe et al. | 86/20.15 |
| 5,531,164 | 7/1996 | Mosley | 102/312 |
| 5,540,293 | 7/1996 | Mohaupt | 175/3.5 |
| 5,542,480 | 8/1996 | Owen et al. | 175/4.15 |
| 5,551,344 | 9/1996 | Couet et al. | 102/312 |
| B1 3,706,344 | 7/1985 | Vann | 166/297 |

CASING WINDOW FORMATION

BACKGROUND OF THE INVENTION

1. Field of the Invention

This invention is related to apparatuses and methods for forming a window in a casing in a wellbore.

2. Description of Related Art

The practice of producing oil from multiple radially dispersed reservoirs, through a single primary wellbore has increased dramatically in recent years. To facilitate this, "kick-off" technology has been developed and continues to grow. This technology allows an operator to drill a vertical well and then continue drilling one or more angled or horizontal holes off of that well at chosen depth(s). Because the initial vertical wellbore is often cased with a string of tubular casing, a "window" must be cut in the casing before drilling the "kick-off". In certain prior art methods windows are cut using various types of milling devices and one or more "trips" of the drill string are needed. Rig. time is very expensive and multiple trips take time and add to the risk that problems will occur.

Another problem encountered in certain typical milling operations is "coring". Coring occurs when the center line of a window mill coincides with the wall of the casing being milled (i.e. the mill is half in and half out of the casing). As the mill is rotating, the point at its centerline has a velocity of zero. A mill's capacity to cut casing depends on some relative velocity between the mill face and the casing being cut. When the centerline of the mill contacts the casing wall its cutting capacity at that point is greatly reduced because the velocity near the centerline is very low relative to the casing and zero at the axial centerline. The milling rate may be correspondingly reduced.

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge adjacent or beneath the cutting blades. An upward flow of the discharged fluid in the annulus outside the tool removes cuttings or chips from the well resulting from the milling operation.

Milling tools have been used for removing a section of existing casing from a well bore to permit a sidetracking operation in directional drilling and to provide a perforated production zone at a desired level. Also, milling tools are used for milling or reaming collapsed casing and for removing burrs or other imperfections from windows in the casing system.

Prior art sidetracking methods use cutting tools of the type having cutting blades. A deflector such as a whipstock causes the tool to be moved laterally while it is being moved downwardly in the well during rotation of the tool to cut an elongated opening pocket, or window in the well casing.

Certain prior art well sidetracking operations which employ a whipstock also employ a variety of different milling tools used in a certain sequence. This sequence of operation may require a plurality of "trips" into the wellbore. For example, in certain multi-trip operations, an anchor, slip mechanism, or an anchor-packer is set in a wellbore at a desired location. This device acts as an anchor against which tools above it may be urged to activate different tool functions. The device typically has a key or other orientation indicating member. The device's orientation is checked by running a tool such as a gyroscope indicator or measuring-while-drilling device into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is releasably secured at the top of the whipstock, e.g. with a shearable setting stud and nut connected to a pilot lug on the whipstock. The tool is then lowered into the wellbore so that the anchor device or packer engages the stinger and the tool is oriented. Slips extend from the stinger and engage the side of the wellbore to prevent movement of the tool in the wellbore; and locking apparatus locks the stinger in a packer when a packer is used. Pulling on the tool then shears the setting stud, freeing the starting mill from the tool. Certain whipstocks are also thereby freed so that an upper concave portion thereof pivots and moves to rest against a tubular or an interior surface of a wellbore. Rotation of the string with the starting mill rotates the mill. The starting mill has a tapered portion which is slowly lowered to contact a pilot lug on the concave face of the whipstock. This forces the starting mill into the casing and the casing is milled as the pilot lug is milled off. The starting mill moves downwardly while contacting the pilot lug or the concave portion and cuts an initial window in the casing. The starting mill is then removed from the wellbore. A window mill, e.g. on a flexible joint of drill pipe, is lowered into the wellbore and rotated to mill down from the initial window formed by the starting mill. A watermelon mill may be used behind the window mill for rigidity; and to lengthen the casing window if desired. Typically then a window mill with a watermelon mill mills all the way down the concave face of the whipstock forming a desired cut-out window in the casing. Then, the window mill is removed and, as a final option, a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

The prior art discloses a variety of chemical and explosive casing cutters and casing perforators. These apparatuses are used to sever casing at a certain location in a wellbore or to provide perforations in casing through which fluid may flow.

There has long been a need for efficient and effective wellbore casing window methods and tools useful in such methods particularly for drilling side or lateral wellbores. There has long been a need for an effective "single trip" method for forming a window in wellbore casing.

SUMMARY OF THE PRESENT INVENTION

The present invention, in one embodiment, discloses a method for forming an opening in a wellbore casing which includes introducing an apparatus including a whipstock or other drill bit or mill diversion device into the wellbore and locating it at a desired point in the wellbore. In one aspect a drill bit is releasably connected to the diversion device. In one aspect a window mill is releasably connected to the whipstock. To create a hole through which drilling of the formation adjacent the hole is possible or to initiate a starting hole or slot for milling in the casing, a shaped charge of explosive is attached to the apparatus. In one aspect the charge is attached to a drill bit; in one aspect to the diversion device; and in another aspect to the window mill. In one aspect the charge is attached below the window mill. The explosive charge is properly designed to form a hole of desired shape and configuration in the casing without damaging the whipstock, drill bit, window mill, or adjacent casing. The explosive is also designed to create a minimum of debris in the wellbore.

In certain embodiments the size, shape, and character of the hole created by the explosive charge is directly dependant on the design of the charge. The relationship between the shape of the charge and the shape of the hole is known as the "Munroe effect"; i.e., when a particular indentation is configured in the "face" of an explosive charge, that configuration is mirrored in a target when the charge is detonated adjacent to the target. Additional enhancement of desired final target configurations is obtained by the use of multiple precision timed explosive initiation, explosive lensing, and internal explosive wave shaping.

In one embodiment an explosive charge (e.g. a linear jet shape charge) is run into a cased wellbore with a whipstock so that the charge is directed 180 degrees from the whipstock concave. It is detonated at the depth that corresponds to the depth of the window mill at which coring is anticipated. This charge cuts an axial slot out of the casing wall so that when the mill encounters the slot, there is no casing on its centerline (casing in that area having been previously removed by the charge), thus preventing coring.

The present invention, in certain embodiments, discloses an apparatus for forming an opening in casing in a cased wellbore, the apparatus having a location device for locating the apparatus in the casing, and an explosive device interconnected with the location device for explosively forming an opening in the casing; in one aspect the opening being a window suitable for wellbore sidetracking operations; such apparatus with the location device including an orienting device for orienting the explosive means radially within the wellbore and the location device including a diversion device for directing a drill bit or a mill; and drill bit for drilling into the formation adjacent the opening or a milling apparatus for milling the casing at the opening, the milling apparatus releasably attached to the location means; such apparatus with the location device having a whipstock with a concave, and milling device or devices for milling the casing releasably connected to the location means; such apparatus wherein the milling device is a window mill; such apparatus wherein the milling devices include at least two mills; such an apparatus wherein the location device includes an anchor apparatus for anchoring the location device in the wellbore; such an apparatus wherein the explosive device is connected to the diversion device and the apparatus has at least one explosive charge sized, configured and located for producing an opening, slot, radial ledge or completed window of a desired size, shape and location in the casing, and a detonator device for detonating the at least one explosive charge; such apparatus wherein the at least one explosive charge is a plurality of explosive charges; such an apparatus wherein the detonator device includes a timer for activating the detonator device at a desired time; such an apparatus including a sequence device for activating the explosive prior to drilling or prior to milling of casing by a mill or mills; such an apparatus wherein the at least one explosive charge is sized, shaped, configured and located so that the opening defines an opening, e.g. a slot, in the casing located to inhibit or prevent coring of a mill milling at the window.

The present invention, in certain embodiments, discloses an apparatus for forming a window in casing in a cased wellbore, the apparatus having a location device for locating the apparatus in the casing; an explosive device interconnected with the location device for explosively forming a window in the casing, the explosive device including at least one explosive charge sized, configured and located for producing a window of a desired size, shape and location in the casing; and a detonator device for detonating the at least one explosive charge; the location device including a whipstock with a concave, and an anchor device for anchoring the location device in the wellbore; and milling apparatus releasably connected to the location device, the milling apparatus including a window mill and/or another mill or mills.

The present invention, in certain embodiments, discloses an apparatus for forming a window in casing in a cased wellbore, the apparatus having a location device for locating the apparatus in the casing, and an explosive device connected to the location device for explosively forming a slot in the casing, the slot defining an opening in the casing located to inhibit or prevent coring of a mill milling at the slot; such an apparatus wherein the location device includes a whipstock with a concave, and the apparatus further has milling apparatus releasably connected to the location means; such an apparatus with the milling apparatus including a window mill; such an apparatus wherein the location device has an anchor device for anchoring the location device in the wellbore; such an apparatus wherein the explosive device has at least one explosive charge sized, configured and located for producing a slot of a desired size, shape and location in the casing, and a detonator device for detonating the at least one explosive charge.

The present invention, in certain embodiments, discloses an apparatus for forming a radial ledge in casing in a cased wellbore, the apparatus having a location device for locating the apparatus in the casing, and an explosive device connected to the location device for explosively forming a radial ledge in the casing, the ledge defining an opening in the casing located to enhance initial casing penetration by a mill milling at the ledge.

The present invention, in certain embodiments, discloses an apparatus for forming a window in casing in a cased wellbore, the apparatus having a location device for locating the apparatus in the casing, and an explosive device connected to the location device for explosively forming a radial ledge and an axial slot in the casing, the combined configuration defining an opening in the casing located to enhance initial casing penetration by a mill, and inhibit or prevent coring of a mill milling at the slot; such an apparatus wherein the mill is releasably attached to the location device; such an apparatus wherein the explosive device is attached to the mill; and such an apparatus wherein the location device has a whipstock with a concave, and the apparatus includes milling apparatus for milling casing releasably connected to the location means.

The present invention, in certain embodiments, discloses a method for forming an opening in a casing of a cased wellbore, the method including locating an opening-forming system at a desired location in casing in a wellbore, the opening-forming system having a location device for locating the apparatus in the casing, and an explosive device connected to the location device for explosively forming an opening in the casing, the opening for facilitating wellbore sidetracking operations, the explosive device including an explosive charge, and the method including exploding the explosive charge adjacent the casing to explosively form the opening; such a method wherein a drill bit is connected to the location device and the method including drilling formation adjacent the opening created by the opening-forming system; such a method wherein the location device includes a whipstock with a concave, and the apparatus device has milling apparatus releasably connected to the location device and the method includes milling at the opening with the milling means; such a method wherein the at least one explosive charge is sized, shaped, configured and located so that the opening created in the casing is located to inhibit or prevent coring of a mill milling at the opening; and such a method wherein the opening includes a radial ledge in the casing for facilitating casing penetration by a mill milling at the ledge.

It is, therefore, an object of at least certain preferred embodiments of the present invention to provide:

New, useful, unique, efficient, non-obvious methods and systems for the formation of an opening in wellbore casing;

Such systems with an explosive charge for initiating a hole in casing;

Such systems for drilling formation adjacent such a hole;

Such systems in which the opening is a window suitable for sidetracking operations;

Such systems useful for milling casing and, in one aspect, for removing a portion of a casing, e.g. a longitudinal slot, to inhibit or prevent mill coring;

Such systems for forming a radial ledge in casing for facilitating milling of the casing;

Such systems which product minimal debris upon activation;

Such systems with which a casing window is formed in a single trip in the hole; and Methods employing such systems for creating an opening; for subsequent milling of casing; and/or for subsequent drilling of formation adjacent an opening.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

DESCRIPTION OF EMBODIMENTS PREFERRED AT THE TIME OF FILING FOR THIS PATENT

Figure 1:
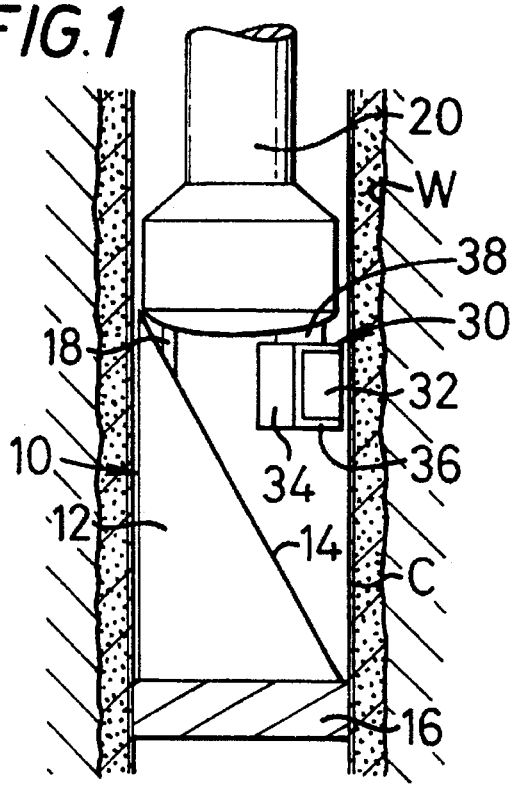
FIG. 1 is a side cross-sectional view of a system according to the present invention.

Referring now to FIG. 1, a system 10 according to the present invention is shown schematically in a wellbore W cased with casing C. The system 10 includes a whipstock 12 with a concave face 14 anchored by an anchor device 16 in the wellbore W. A window mill 20 is releasably connected to the whipstock 12 e.g. with a shear stud 18 (or with an hydraulic release device).

An explosive charge system 30 is secured to the whipstock 12 (e.g. by any suitable securement apparatus, device, or method) (or to the window mill 20). Shock attenuation material 36 is preferably disposed on the sides of the explosive charge except the side facing the casing. The system 30 includes a typical amount of an explosive 32 and a typical detonator device 34. The explosive 32 may be detonated at a desired moment in time using any suitable known apparatus or mechanism.

Detonation may be effected by employing drill string pressure, annulus pressure, pressure sequencing, mechanical devices (e.g. bar drop through drill string I.D.), or electric wireline run.

The explosive 32 is sized and configured to create a hole in the casing of desired size, location, and configuration. The window mill 20 is located so that it takes advantage of the hole created by the system 30 and can complete the formation of a window in the casing in a single trip of the system 10 into the hole.

Figure 2:
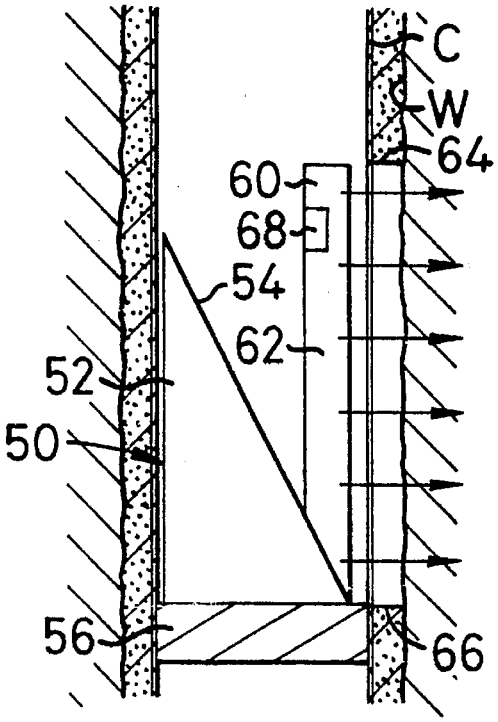
FIG. 2 is a side cross-sectional view of a system according to the present invention.

FIG. 2 illustrates schematically a system 50 according to the present invention in a wellbore W cased with casing C. The system 50 with a concave face 54 anchored in the wellbore W with an anchor 56.

An explosive charge system 60 is secured to the whipstock 52 and is shaped, sized, and configured to form a slot in the casing C between the points 64, 66. Rather than encountering casing and producing coring of a mill (not shown; like the window mill 20, FIG. 1), a mill encounters the slot and coring is inhibited or prevented. Preferably the explosive charge system 60 is self-consuming and no part of it remains after the explosion on the whipstock or in the slot to inhibit subsequent milling. The system 60 may include any known mill or multiple mill combination. The system 60 includes an amount of known explosive 62 and a detonator apparatus 68. The whipstock 52 may be any known whipstock or mill diversion device; the whipstock 52 may be a hollow whipstock. The arrows in FIG. 2 indicate the direction of the effects of the explosion of the explosive 62.

Figure 3:
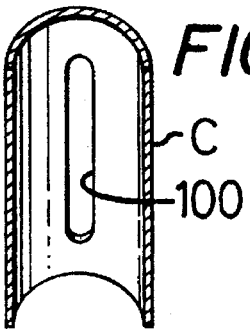
FIG. 3 is a schematic view of a slot formed in casing using a system according to the present invention.

FIG. 3 shows casing C with a slot 100 formed therethrough explosively with a system according to the present invention as described above at a desired location for a completed window for wellbore sidetracking operations. Additional milling at the slot will complete a window and, as a mill moves down the slot coring of the mill when it is half in and half out of the casing is inhibited or prevented.

Figure 4:
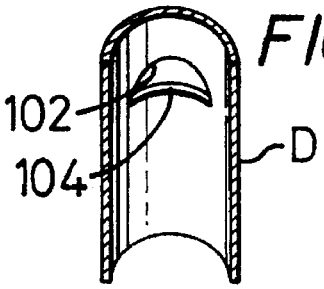
FIG. 4 is a schematic view of a radial ledge opening formed in casing using a system according to the present invention.

FIG. 4 shows a casing D with a hole 102 and a radial ledge 104 therethrough formed explosively with a system according to the present invention. Such a hole and ledge facilitate initial milling starting at the location of the ledge.

Figure 5:
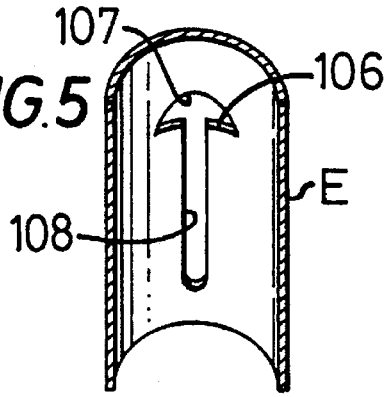
FIG. 5 is a schematic view of an opening in casing including a radial ledge and a slot formed using a system according to the present invention.

FIG. 5 shows a casing E with a composite opening formed explosively with a system as described above with a ledge 106 (like the ledge 104), a hole 107 (like the hole 102), and a slot 108 (like the slot 100) to facilitate milling at the location of the ledge and slot.

Figure 6:
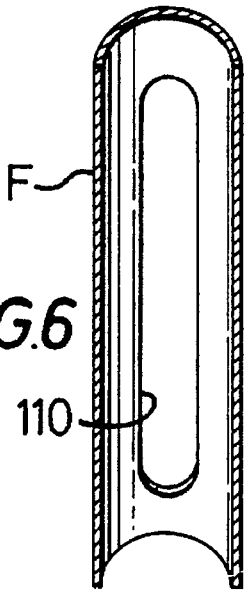
FIG. 6 is a schematic view of a window opening formed in casing using a system according to the present invention.

FIG. 6 shows a casing F with a completed wellbore sidetracking window 110 formed explosively with a system as described above.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. Apparatus for forming a window in casing in a cased wellbore, the apparatus comprising location means for locating the apparatus in the casing, and explosive means interconnected with the location means for explosively forming a window in the casing, the window suitable for wellbore sidetracking operations.

2. The apparatus of claim 1 further comprising the location means including orienting means for orienting the explosive means radially within the wellbore and the location means including a diversion means for directing another device releasably attached to the location means.

3. The apparatus of claim 2 wherein the another device is a drill bit.

4. The apparatus of claim 2 wherein the another device is a milling means for milling the casing.

5. The apparatus of claim 4 further comprising the milling means comprising a window mill.

6. The apparatus of claim 4 further comprising the milling means comprising at least two mills.

7. The apparatus of claim 4 wherein the explosive means is connected to the mill diversion means and the apparatus comprises further at least one explosive charge sized, configured and located for producing a window of a desired size, shape and location in the casing, and a detonator device for detonating the at least one explosive charge.

8. The apparatus of claim 7 wherein the at least one explosive charge is a plurality of explosive charges.

9. The apparatus of claim 7 wherein the detonator device includes a timer for activating the detonator device at a desired time.

10. The apparatus of claim 7 wherein the at least one explosive charge is sized, shaped, configured and located so that the window defines an opening in the casing located to inhibit or prevent coring of a mill milling at the window.

11. The apparatus of claim 2 further comprising sequence means for activating the explosive means prior to use of the another device.

12. The apparatus of claim 1 further comprising the location means including a whipstock with a concave, and the apparatus further comprising milling means for milling the casing releasably connected to the location means.

13. The apparatus of claim 1 wherein the location means include anchor means for anchoring the location means in the wellbore.

14. Apparatus for forming a window in casing in a cased wellbore, the apparatus comprising location means for locating the apparatus in the casing, explosive means interconnected with the location means for explosively forming a window in the casing, the explosive means including at least one explosive charge sized, configured and located for producing a window of a desired size, shape and location in the casing, and a detonator device for detonating the at least one explosive charge, the location means including a whipstock with a concave, and anchor means for anchoring the location means in the wellbore, and milling means releasably connected to the location means, the milling means including a window mill.

15. Apparatus for forming a window in casing in a cased wellbore, the apparatus comprising location means for locating the apparatus in the casing, and explosive means connected to the location means for explosively forming a slot in the casing, the slot defining an opening in the casing located to inhibit or prevent coring of a mill milling at the slot.

16. The apparatus of claim 15 further comprising the location means including a whipstock with a concave, and the apparatus further comprising milling means releasably connected to the location means.

17. The apparatus of claim 15 further comprising the milling means comprising a window mill.

18. The apparatus of claim 15 wherein the location means include anchor means for anchoring the location means in the wellbore.

19. The apparatus of claim 15 wherein the explosive means comprises at least one explosive charge sized, configured and located for producing a slot of a desired size, shape and location in the casing, and a detonator device for detonating the at least one explosive charge.

20. Apparatus for forming a radial ledge in casing in a cased wellbore, the apparatus comprising location means for locating the apparatus in the casing, and explosive means connected to the location means for explosively forming a radial ledge in the casing, the ledge defining an opening in the casing located to enhance initial casing penetration by a mill milling at the ledge.

21. Apparatus for forming a window in casing in a cased wellbore, the apparatus comprising location means for locating the apparatus in the casing, and explosive means connected to the location means for explosively forming a radial ledge and an axial slot in the casing, the combined configuration defining an opening in the casing located to enhance initial casing penetration by a mill, and inhibit or prevent coring of a mill milling at the slot.

22. The apparatus of claim 21 further comprising a milling means releasably attached to the location means.

23. The apparatus of claim 21 wherein the explosive means is attached to the milling means.

24. The apparatus of claim 21 further comprising the location means including a whipstock with a concave, and the apparatus further comprising milling means for milling casing releasably connected to the location means.

25. A method for forming an opening in a casing of a cased wellbore, the method comprising locating an opening-forming system at a desired location in casing in a wellbore, the opening-forming system comprising location means for locating the apparatus in the casing, and explosive means connected to the location means for explosively forming an opening in the casing, the opening for facilitating wellbore sidetracking operations, the explosive means including an explosive charge, and exploding the explosive charge adjacent the casing to explosively form the opening.

26. The method of claim 25 wherein the location means includes a whipstock with a concave, and the apparatus further comprises milling means releasably connected to the location means and the method further comprises milling at the opening with the milling means.

27. The method of claim 25 wherein the at least one explosive charge is sized, shaped, configured and located so that the opening created in the casing is located to inhibit or prevent coring of a mill milling at the window.

28. The method of claim 25 wherein the opening includes a radial ledge in the casing for facilitating casing penetration by a mill milling at the ledge.

29. The method of claim 25 wherein the opening is a completed window for wellbore sidetracking operations.

30. The method of claim 25 wherein drilling means for drilling formation adjacent the opening is releasably connected to the location means and the method further comprising drilling the formation with the drilling means.

* * * * *